US011551890B2

(12) United States Patent
Chan et al.

(10) Patent No.: US 11,551,890 B2
(45) Date of Patent: Jan. 10, 2023

(54) KEYSWITCH PREVENTING LATERAL SLIDING

(71) Applicant: DARFON ELECTRONICS CORP., Taoyuan (TW)

(72) Inventors: Jin-Long Chan, Taoyuan (TW); Yu-Chih Chang, Taoyuan (TW); Cheng-Min Su, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 106 days.

(21) Appl. No.: 16/809,510

(22) Filed: Mar. 4, 2020

(65) Prior Publication Data

US 2021/0175028 A1 Jun. 10, 2021

(30) Foreign Application Priority Data

Dec. 5, 2019 (TW) ..... 108144417

(51) Int. Cl.
*H01H 13/705* (2006.01)

(52) U.S. Cl.
CPC ..... *H01H 13/705* (2013.01)

(58) Field of Classification Search
CPC .. H01H 13/705; H01H 3/125; H01H 13/7065; H01H 2221/024; H01H 2221/05; H01H 2221/06; H01H 3/12; H01H 13/14; H01H 13/07
See application file for complete search history.

(56) References Cited

U.S. PATENT DOCUMENTS

| | | | | |
|---|---|---|---|---|
| 6,118,092 | A | 9/2000 | Hayashi | |
| 6,706,985 | B2 | 3/2004 | Chun | |
| 8,299,382 | B2 * | 10/2012 | Takemae | H01H 3/125 200/344 |
| 10,867,759 | B2 * | 12/2020 | Chao | H01H 3/125 |
| 2021/0012983 | A1 * | 1/2021 | Chao | H01H 3/125 |

FOREIGN PATENT DOCUMENTS

| | | | |
|---|---|---|---|
| CN | 202678165 | U | 1/2013 |
| CN | 106128810 | B | 7/2018 |
| TW | M436188 | U1 | 8/2012 |
| WO | 2019/052377 | A1 | 3/2019 |

* cited by examiner

*Primary Examiner* — Lheiren Mae A Caroc
(74) *Attorney, Agent, or Firm* — Winston Hsu

(57) ABSTRACT

A keyswitch includes a cap, first and second support members slidably connected to the cap and opposite to each other, and first and second blocks formed on the cap. The cap is movable between a non-pressed position and a pressed position. The first support member abuts against the first block when the cap is located at the non-pressed position. The first block moves away from the first support member at a first gap when the cap moves downward from the non-pressed position. The first support member abuts against the cap when the cap is located at the non-pressed position, and abuts against the second block when the cap continues moving downward to the pressed position.

11 Claims, 8 Drawing Sheets

KEYSWITCH PREVENTING LATERAL SLIDING

BACKGROUND OF THE INVENTION

1. Field of the Invention

The present invention relates to a keyswitch, and more specifically, to a keyswitch utilizing blocks to prevent lateral sliding of a cap.

2. Description of the Prior Art

A keyboard, which is the most common input device, can be found in variety of electronic apparatuses for users to input characters, symbols, numerals and so on. Furthermore, consumer electronic products and industrial machine tools are all equipped with a keyboard for performing input operations.

In general, a keyswitch on the keyboard usually adopts the design that a scissor support mechanism is disposed between a cap and a board to make the cap movable relative to the board. However, since the aforesaid design requires more internal space of the keyswitch and the overall height of the keyswitch is thus increased, it is disadvantageous to the thinning design of the keyboard. As such, a V-shaped support mechanical design is accordingly applied to the keyboard and involves connecting two support members in a V-shaped arrangement to the board pivotably and connecting the two support members to the cap slidably to make the cap movable relative to the board. In this design, since the two support members are slidably connected to the cap, it may cause lateral sliding of the cap relative to the support members when a user presses the keyswitch, so as to influence the pressing feeling provided by the keyswitch.

SUMMARY OF THE INVENTION

The present invention provides a keyswitch including a cap, a first support member, a second support member, a first block, and a second block. The cap is movable between a non-pressed position and a pressed position. The first support member has a first sliding end portion. The first sliding end portion is slidably connected to the cap to be movable along a first involute track with movement of the cap. The second support member is slidably connected to the cap. The second support member is opposite to the first support member. The first block is formed on the cap. A first concave structure extends from the first block along the first involute track. The first sliding end portion has a first convex structure. The first convex structure abuts against the first block or is spaced apart from the first concave structure at a first gap when the first sliding end portion moves along the first involute track. The second block is formed on the cap. A second concave structure extends from the second block along the first involute track. The first sliding end portion further has a second convex structure. The second convex structure abuts against the cap or the second concave structure when the first sliding end portion moves along the first involute track.

The present invention further provides a keyswitch including a board, a first support member, a second support member, a first block, and a second block. The first support member has a first sliding end portion. The first sliding end portion is slidably connected to the board to be movable along a first involute track relative to the board. The second support member is slidably connected to the board. The second support member is opposite to the first support member. The first block is formed on the board. The first concave structure extends from the first block along the first involute track. The first sliding end portion has a first convex structure. The first convex structure abuts against the first block or is spaced apart from the first concave structure at a first gap when the first sliding end portion moves along the first involute track. The second block is formed on the board. A second concave structure extends from the second block along the first involute track. The first sliding end portion further has a second convex structure. The second convex structure abuts against the board or the second concave structure when the first sliding end portion moves along the first involute track.

The present invention further provides a keyswitch including a cap, a board, a first support member, a second support member, a first block, and a second block. The cap is movable between a non-pressed position and a pressed position. The board is disposed opposite to the cap. The first support member and the second support member are opposite to each other and slidably connected between the cap and the board. The first support member has a first sliding end portion. The first sliding end portion is slidably connected to the cap to be movable along a first involute track with movement of the cap. The first sliding end portion has a first convex structure and a second convex structure. The first block and the second block are formed on the cap and opposite to each other. A first concave structure and a second concave structure extend from the first block and the second block respectively along the first involute track. When the first sliding end portion moves along the first involute track, the first convex structure of the first sliding end portion abuts against the first block or is spaced apart from the first concave structure at a first gap, and the second convex structure abuts against the cap or the second concave structure.

The present invention further provides a keyswitch including a cap, a first support member, a second support member, a first block, and a third block. The cap is movable between a non-pressed position and a pressed position. The first support member and the second support member are slidably connected to the cap and configured opposite to each other. The first support member has a first sliding end portion slidably connected to the cap to be movable along with movement of the cap.

The first sliding end portion has a first convex structure in a concave slot defined on the first support member. The first block and the third block are formed on the cap and opposite to each other, and have a first concave structure and a third concave structure respectively defined at an outer side of each of the first block and the third block.

When the cap moves to the pressed position, the first concave structure of the first block is moved to face the first convex structure in the concave slot of the first support member.

Preferably, the first block includes a raised end, a recessed bottom in the concave slot is defined adjacent to the first convex structure, and the raised end of the first block is moved to proximately face the recessed bottom in the concave slot when the cap moves to the pressed position.

Preferably, a flat surface is defined at an inner side of the first block, a plane is defined at an internal side of the concave slot, and the flat surface of the first block is moved to proximately face the plane of the concave slot when the cap moves to the pressed position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
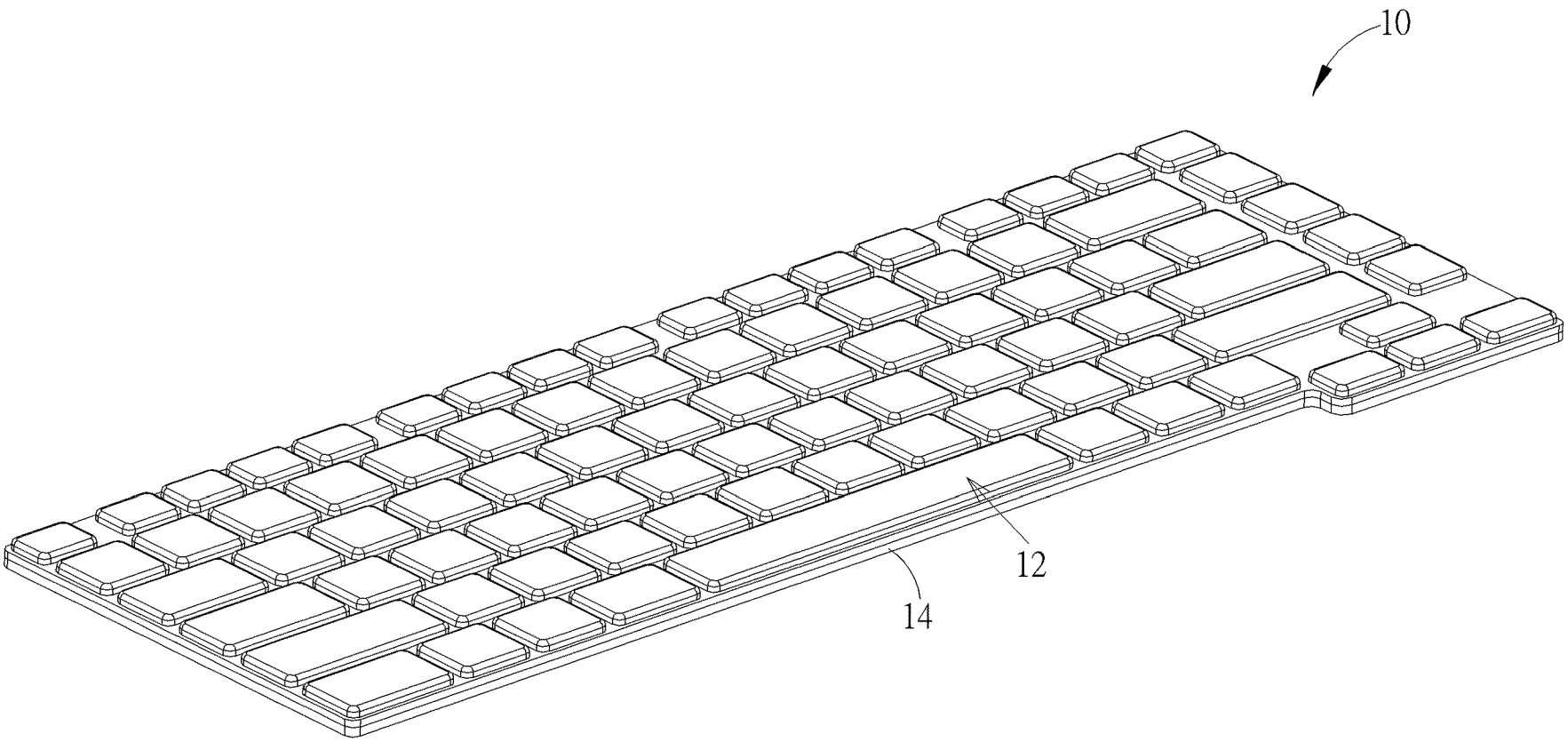
FIG. 1 is a diagram of a keyboard according to an embodiment of the present invention.

Please refer to FIG. 1, which is a diagram of a keyboard 10 according to an embodiment of the present invention. As shown in FIG. 1, the keyboard 10 includes a plurality of keyswitches 12 for a user to perform input operations. In the present invention, the design for preventing lateral sliding of a cap could be applied to at least one of the plurality of keyswitches 12. In the following, more detailed description for only one keyswitch 12 to which the aforesaid design is applied is provided. As for the related description for other keyswitches 12 utilizing the same design, it could be reasoned by analogy.

Figure 2:
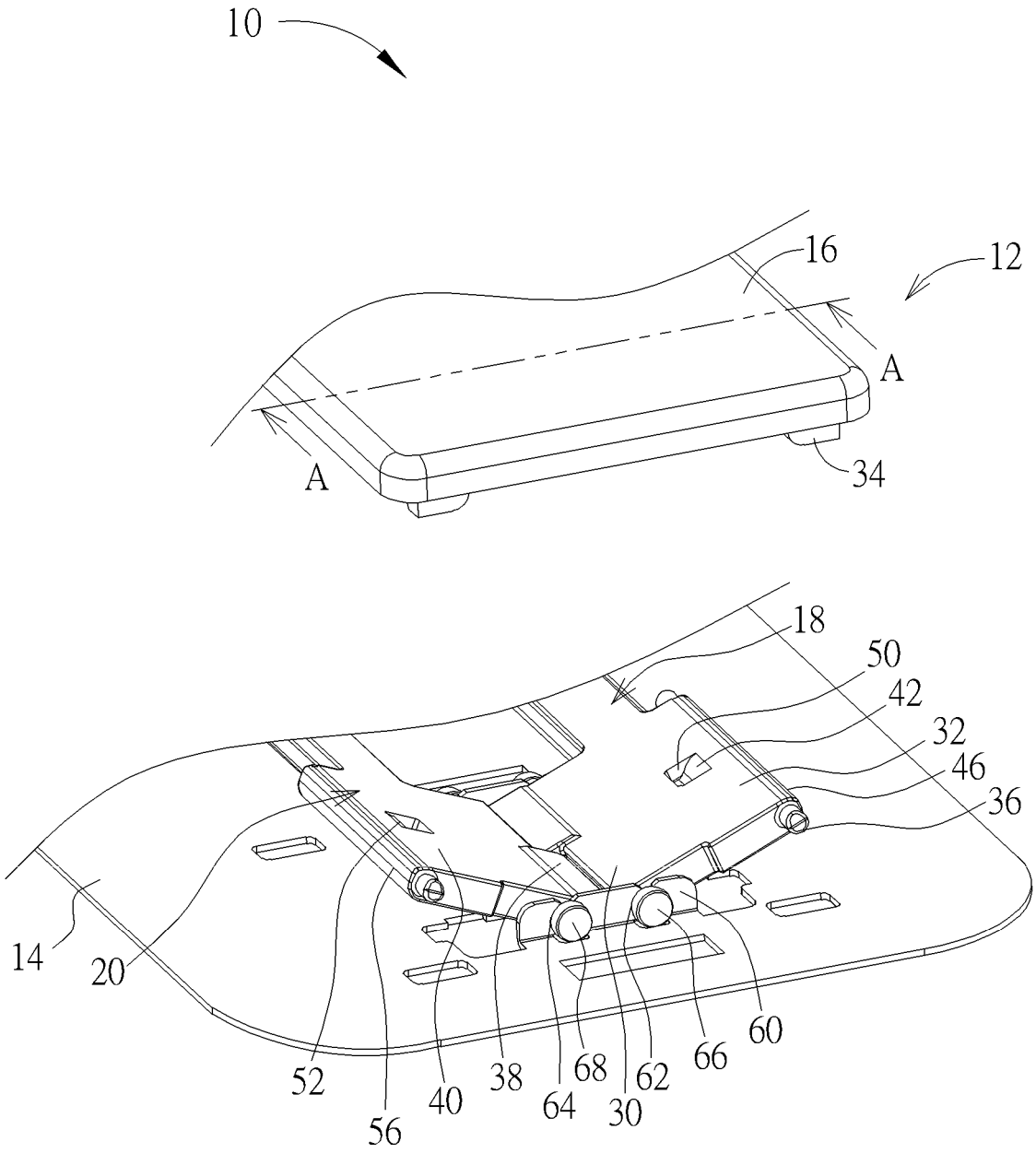
FIG. 2 is a partial exploded diagram of a keyswitch in FIG. 1.
Figure 3:
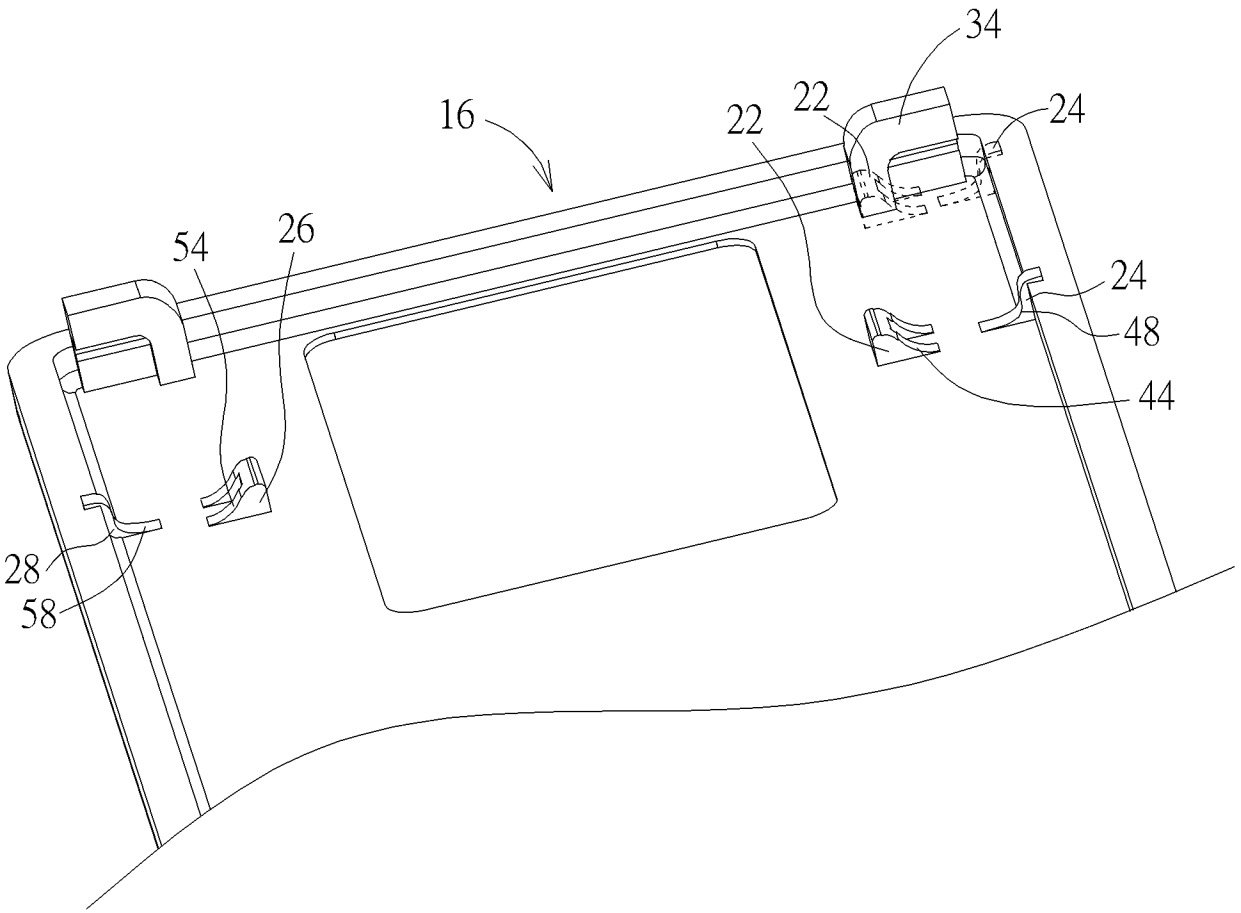
FIG. 3 is a partial enlarged diagram of a cap in FIG. 2 from another viewing angle.
Figure 4:
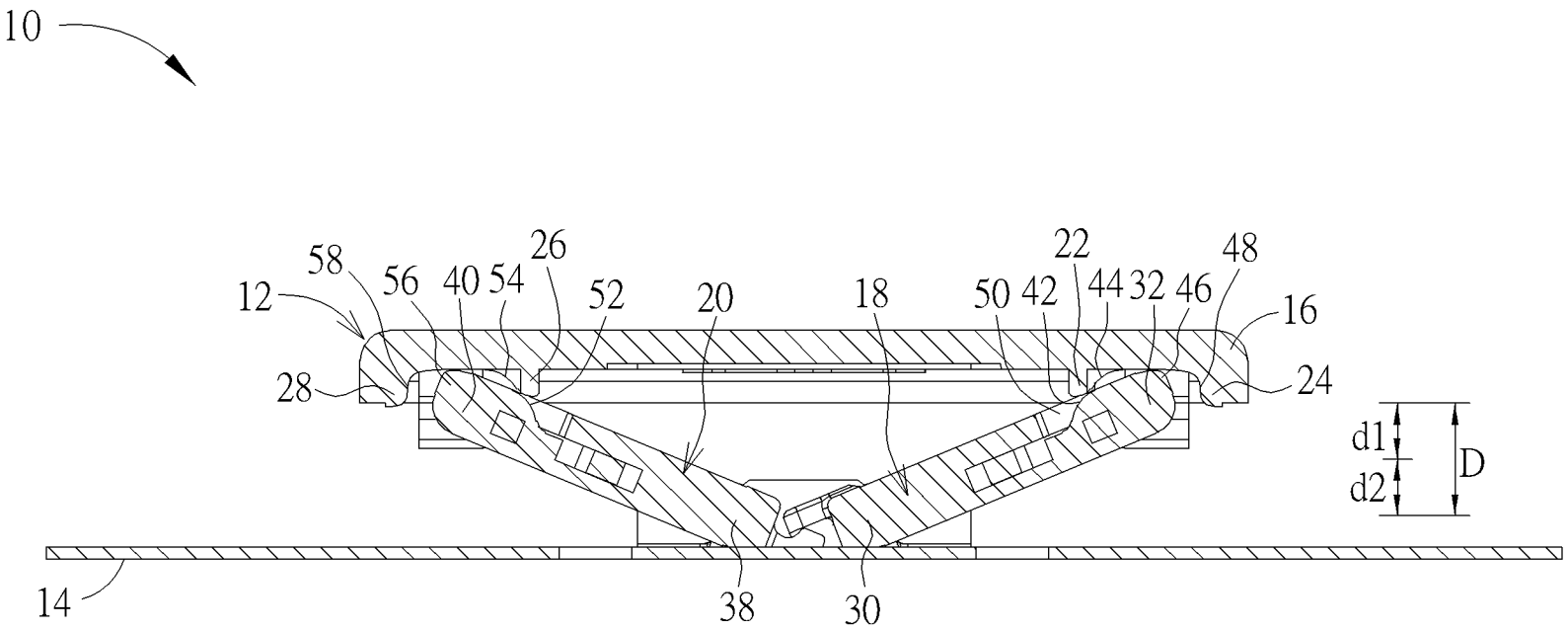
FIG. 4 is a cross-sectional diagram of the keyswitch in FIG. 2 along a cross-sectional line A-A.

Please refer to FIGS. 2-4. FIG. 2 is a partial exploded diagram of the keyswitch 12 in FIG. 1. FIG. 3 is a partial enlarged diagram of a cap 16 in FIG. 2 from another viewing angle. FIG. 4 is a cross-sectional diagram of the keyswitch 12 in FIG. 2 along a cross-sectional line A-A. As shown in FIGS. 2-4, the keyswitch 12 preferably includes a board 14 (could be selectively omitted in this embodiment), the cap 16, a first support member 18, a second support member 20, a first block 22, a second block 24, a third block 26, and a fourth block 28.

In this embodiment, the first support member 18 has a first pivot end portion 30 and a first sliding end portion 32. The first sliding end portion 32 is slidably connected to the cap 16 and the first pivot end portion 30 is pivoted to the board 14, so as to make the first sliding end portion 32 movable along a first involute track relative to the first pivot end portion 30 (the related description for pivoting of a keyswitch support member along an involute track is commonly seen in the prior art and is omitted herein). In practical application, as shown in FIGS. 2-3, a sliding slot 34 is formed on the cap 16, and a sliding shaft 36 protrudes from the first sliding end portion 32 toward the sliding slot 34. Accordingly, the sliding shaft 36 can be slidably inserted into the sliding slot 34 for guiding the first sliding end portion 32 to slide more smoothly. The second support member 20 has a second pivot end portion 38 and a second sliding end portion 40. The second sliding end portion 40 is slidably connected to the cap 16 and the second pivot end portion 38 is pivoted to the board 14, so as to make the second sliding end portion 40 movable along a second involute track relative to the second pivot end portion 38 with movement of the cap 16. In such a manner, via the connection design that the first support member 18 and the second support member 20 are opposite to each other and are slidably connected to the cap 16 and pivoted to the board 14 for forming a V-shaped support mechanism, the cap 16 can move a travelling distance D (preferably 1.2 mm or 1.6 mm, but not limited thereto) between a non-pressed position and a pressed position relative to the board 14 (as shown in FIG. 4).

Furthermore, as shown in FIG. 3 and FIG. 4, the first block 22 is formed on the cap 16 and located at an inner side of the first sliding end portion 32. The first sliding end portion 32 has a first convex structure 42 corresponding to the first block 22. The first convex structure 42 abuts against the first block 22 when the cap 16 is located at the non-pressed position. A first concave structure 44 extends from the first block 22 correspondingly along the first involute track of the first sliding end portion 32. As such, when the first sliding end portion 32 moves along the first involute track, the first convex structure 42 can abut against the first block 22 or can move away from the first concave structure 44. To be more specific, via the first convex structure 42 and the first concave structure 44 extending along the first involute track of the first sliding end portion 32 respectively, the first block 22 can block the first support member 18 when the cap 16 is located at the non-pressed position and is spaced apart from the first support member 18 at a proper gap during the process of the cap 16 being pressed.

On the other hand, the second block 24 is formed on the cap 16 and located at an outer side of the first sliding end portion 32 to be aligned with the first block 22 (but not limited thereto, meaning that the present invention could adopt the block design that the first block 22 is misaligned with the second block 24 in another embodiment). The first sliding end portion 32 further has a second convex structure 46. The second convex structure 46 abuts against the cap 16 when the cap 16 is located at the non-pressed position. A second concave structure 48 extends from the second block 24 correspondingly along the first involute track of the first sliding end portion 32. As such, when the first sliding end portion 32 moves along the first involute track, the second convex structure 46 can abut against the cap 16 or the second concave structure 48. To be more specific, via the second convex structure 46 and the second concave structure 48 extending along the first involute track of the first sliding end portion 32 respectively, the second block 24 can be spaced apart from the first support member 18 at a proper gap during the process of the cap 16 being pressed and can block the first support member 18 when the cap 16 is located at the pressed position.

In practical application, a concave slot 50 could be formed on the first support member 18 corresponding to the first block 22, and the first convex structure 42 could be formed in the concave slot 50. Accordingly, when the cap 16 is located at the pressed position, the first block 22 can enter the concave slot 50 to be spaced apart from the first convex structure 42, so as to efficiently prevent the first support member 18 from interfering with the first block 22 during pivoting of the first support member 18.

Similarly, the third block 26 is formed on the cap 16 and located at an inner side of the second sliding end portion 40. The second sliding end portion 40 has a third convex structure 52. The third convex structure 52 abuts against the third block 26 when the cap 16 is located at the non-pressed position. A third concave structure 54 extends from the third block 26 correspondingly along the second involute track of the second sliding end portion 40. As such, when the second sliding end portion 40 moves along the second involute track, the third convex structure 52 can abut against the third block 26 or can move away from the third concave structure 54. To be more specific, via the third convex structure 52 and the third concave structure 54 extending along the second involute track of the second sliding end portion 40 respectively, the third block 26 can block the second support member 20 when the cap 16 is located at the non-pressed position and is spaced apart from the second support member 20 at a proper gap during of the process of the cap 16 being pressed. On the other hand, the fourth block 28 is formed on the cap 16 and located at an outer side of the second sliding end portion 40 to be aligned with the third block 26 (but not limited thereto, meaning that the present invention could adopt the block design that the third block 26 is misaligned with the fourth block 28 in another embodiment). The second sliding end portion 40 further has a fourth convex structure 56. The fourth convex structure 56 abuts against the cap 16 when the cap 16 is located at the non-pressed position. A fourth concave structure 58 extends from the fourth block 28 correspondingly along the second involute track of the second sliding end portion 40. As such, when the second sliding end portion 40 moves along the second involute track, the fourth convex structure 56 can abut against the cap 16 or the fourth concave structure 58. To be more specific, via the fourth convex structure 56 and the fourth concave structure 58 extending along the second involute track of the second sliding end portion 40 respectively, the fourth block 28 can be spaced apart from the second support member 20 at a proper gap during the process of the cap 16 being pressed and can block the second support member 20 when the cap 16 is located at the pressed position.

To be noted, the present invention could preferably adopt the design that the first support member 18 and the second support member 20 are pivoted to the board 14 at different shafts. In this embodiment, as shown in FIG. 2, a pivot sheet 60 is formed on the board 14 and has a first pivot hole 62 and a second pivot hole 64. A first pivot shaft 66 protrudes from the first pivot end portion 30 toward the first pivot hole 62 to be pivotably inserted into the first pivot hole 62, and a second pivot shaft 68 protrudes from the second pivot end portion 38 toward the second pivot hole 64 to be pivotably inserted into the second pivot hole 64. Accordingly, the first support member 18 and the second support member 20 can rotate on the board 14 at the first pivot shaft 66 and the second pivot shaft 68 respectively. Furthermore, in another embodiment, the present invention could adopt the design that the first support member 18 and the second support member 20 are pivoted to the board 14 at the same shaft. For example, the first pivot end portion 30 could be pivoted to the second pivot end portion 38 in a shaft-hole engagement manner, and the related description could be reasoned by analogy according to the aforesaid embodiment and omitted herein.

In addition, the keyswitch 12 could adopt the keyswitch triggering and returning design. For example, the present invention could dispose a rubber dome between a cap and a circuit board of a keyswitch corresponding to a switch on the circuit board, but not limited thereto, meaning that the present invention could adopt other returning member (e.g. a metal dome or a compressed spring), or could adopt other returning design (e.g. a stretched spring could be horizontally connected between two support members of the keyswitch for providing a returning force). Accordingly, when the keyswitch is pressed to the pressed position by an external force, the cap can deform the rubber dome to trigger the switch for performing the corresponding input function. On the other hand, when the external force is released, the rubber dome provides a returning force to drive the cap upward to the non-pressed position for generating the cap returning effect.

Figure 5:
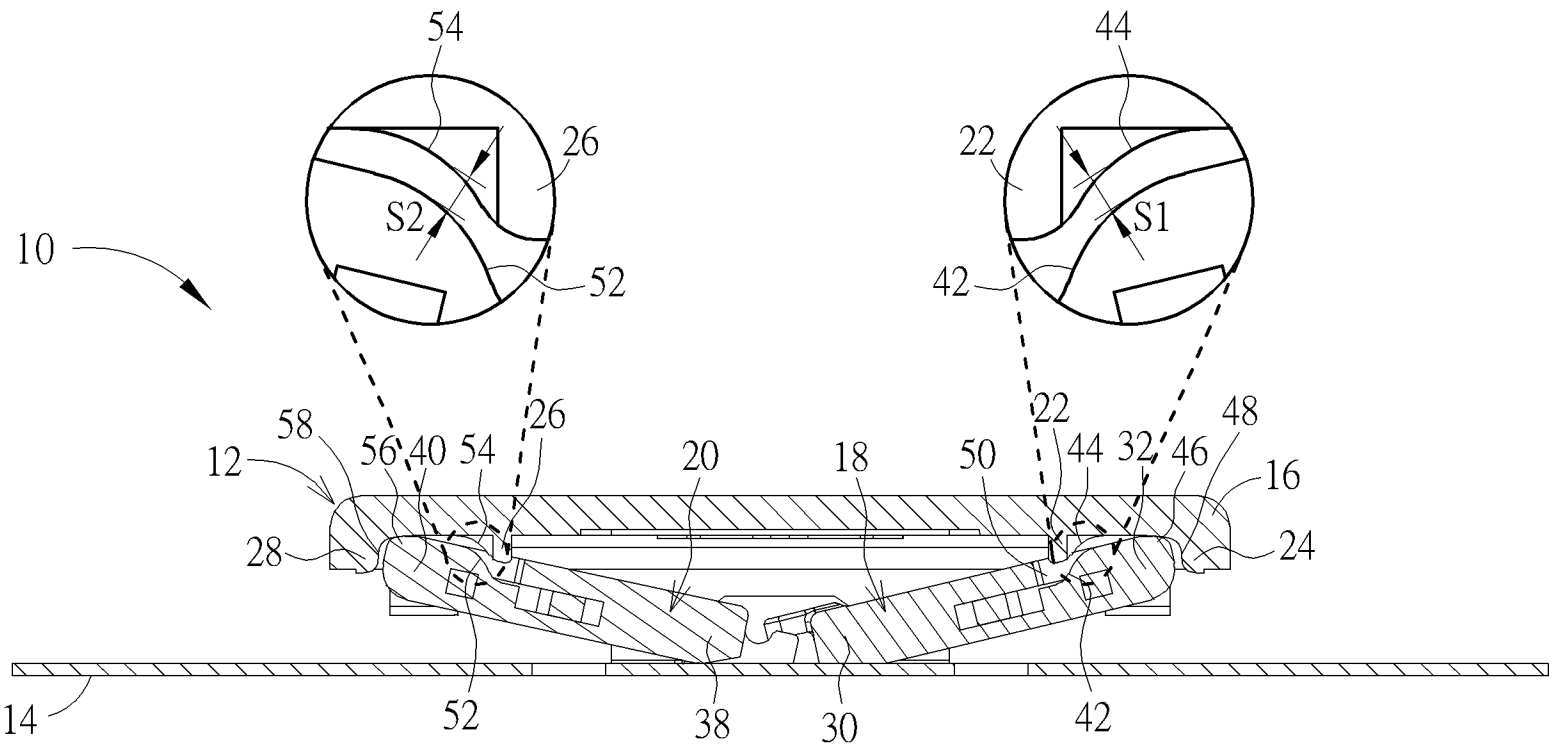
FIG. 5 is a cross-sectional diagram of the cap in FIG. 4 moving a first distance downward.
Figure 6:
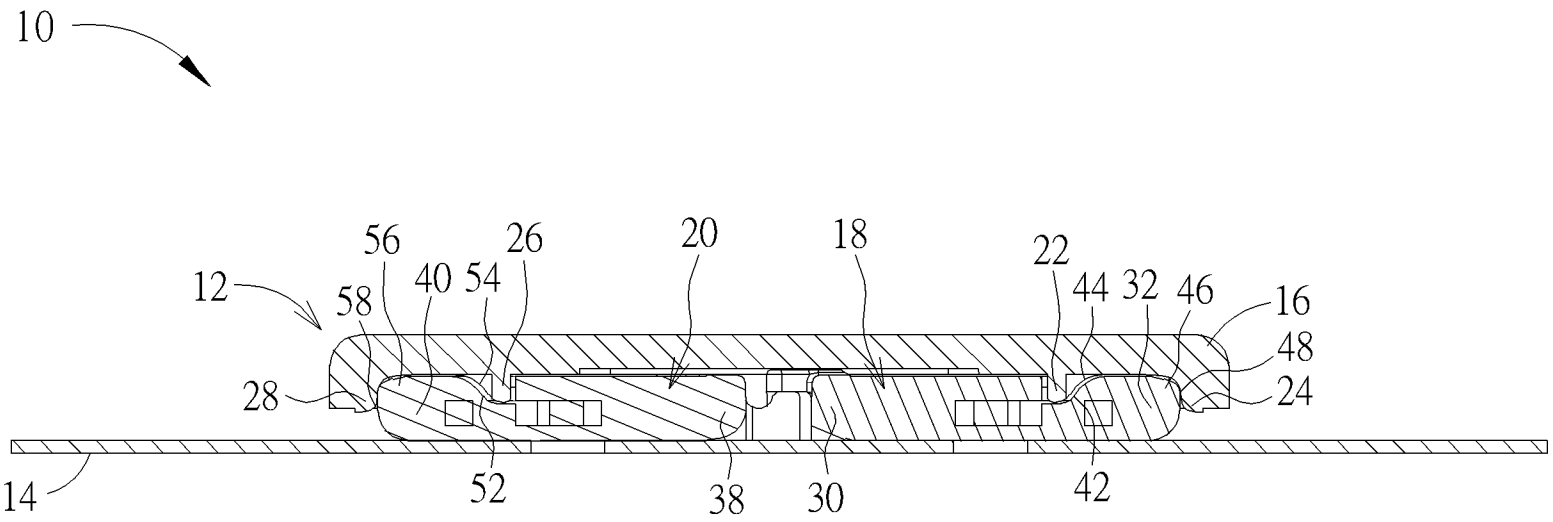
FIG. 6 is a cross-sectional diagram of the cap in FIG. 5 continuing moving a second distance downward.

Via the aforesaid designs, as shown in FIGS. 4-6, when the cap 16 is not pressed, the first convex structure 42 abuts against the first block 22, the second convex structure 46 and the fourth convex structure 56 abut against the cap 16 respectively, and the third convex structure 52 abuts against the third block 26. In such a manner, the cap 16 can be supported at the non-pressed position as shown in FIG. 4 steadily. Subsequently, when the cap 16 moves a first distance d1 downward from the non-pressed position as shown in FIG. 4, the first convex structure 42 is spaced apart from the first concave structure 44 at a first gap S1, and the third convex structure 52 is spaced apart from the third convex structure 54 at a second gap S2. The first gap S1 and the second gap S2 could preferably be equal to 0.5 mm, but not limited thereto, meaning that the first gap S1 and the second gap S2 can be adjusted according to the practical application of the keyboard 10. In summary, via the aforesaid design that the blocks have the concave structures extending along the involute tracks of the support members, the present invention can surely prevent the cap 16 from interfering with the first support member 18 and the second support member 20 when the cap 16 is pressed, so as to improve the pressing feeling provided by the cap 16 and motion smoothness of the cap 16.

Finally, when the cap 16 continues moving a second distance d2 downward to the pressed position as shown in FIG. 6, the second convex structure 46 abuts against the second concave structure 48 and the fourth convex structure 56 abuts against the fourth concave structure 58, so as to prevent the cap 16 from moving leftward and rightward relative to the first support member 18 and the second support member 20. In such a manner, the present invention can efficiently solve the prior art problem that the V-shaped support mechanical design causes lateral sliding of the cap relative to the support members, so as to improve the pressing feeling provided by the keyswitch. To be noted, a sum of the first distance d1 and the second distance d2 could preferably be equal to the travelling distance D, and a ratio of the first distance d1 to the second distance d2 could preferably be equal to 1:1 (but not limited thereto, meaning that the present invention could adopt other ratio design in another embodiment, such as 1:2).

It should be mentioned that the third block and the fourth block could be omitted. In brief, in the embodiment that the third block and the fourth block are omitted, the keyswitch of the present invention could only utilize the first block and the second block to block the first support member for achieving the one-sided blocking purpose, so as to simplify the structural design of the keyswitch. Furthermore, the structural configuration of the blocks and the sliding slot of the cap is not limited to the aforesaid embodiment. For example, in another embodiment as shown in FIG. 3, the first block 22 (depicted by dotted lines in FIG. 3) could be formed in the sliding slot 34 of the cap 16 and the second block 24 (depicted by dotted lines in FIG. 3) could be aligned with the first block 22 on the cap 16. As for the related description for the other derived embodiments, it could be reasoned by analogy according to the aforesaid embodiments and omitted herein.

Figure 7:
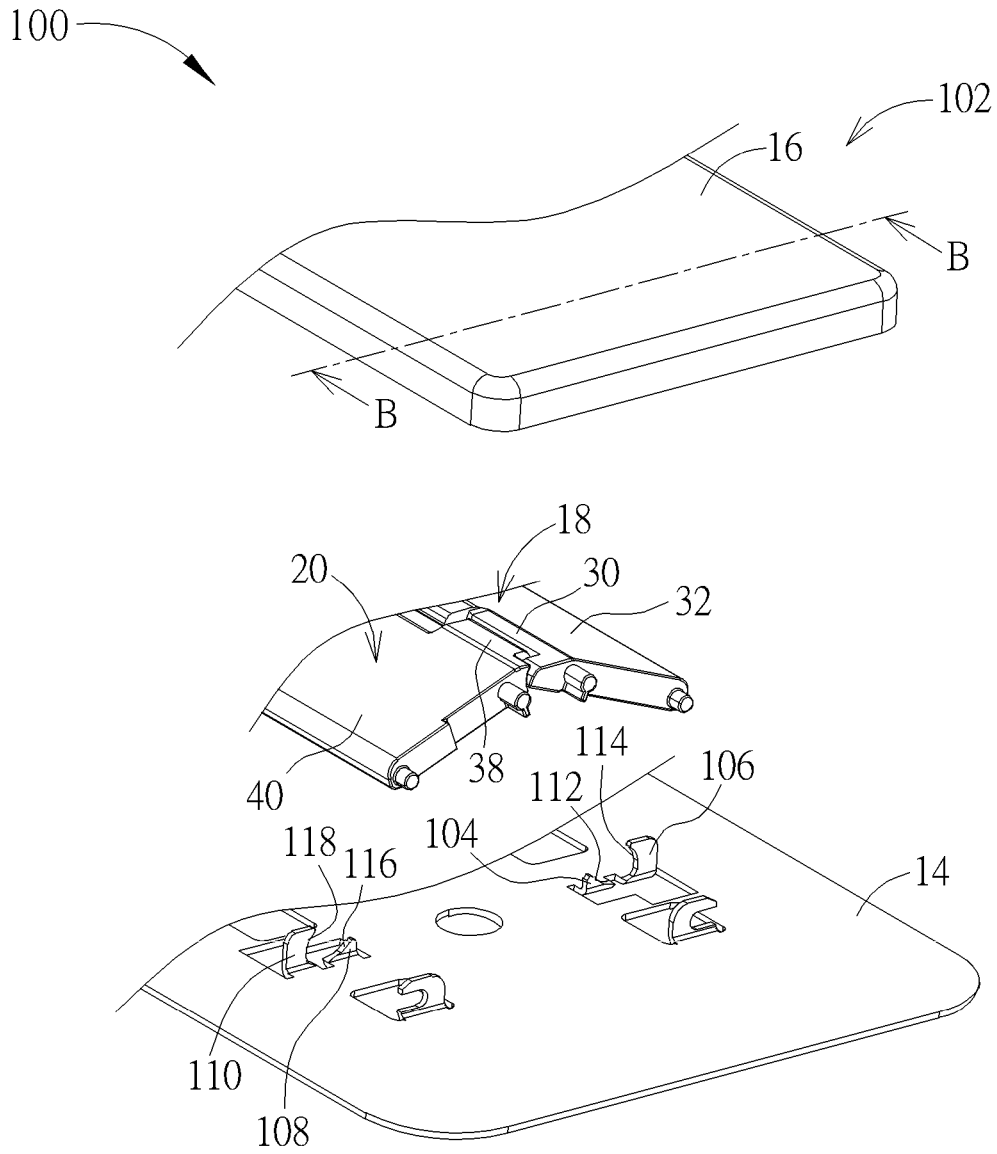
FIG. 7 is a partial exploded diagram of a keyboard according to another embodiment of the present invention.
Figure 8:
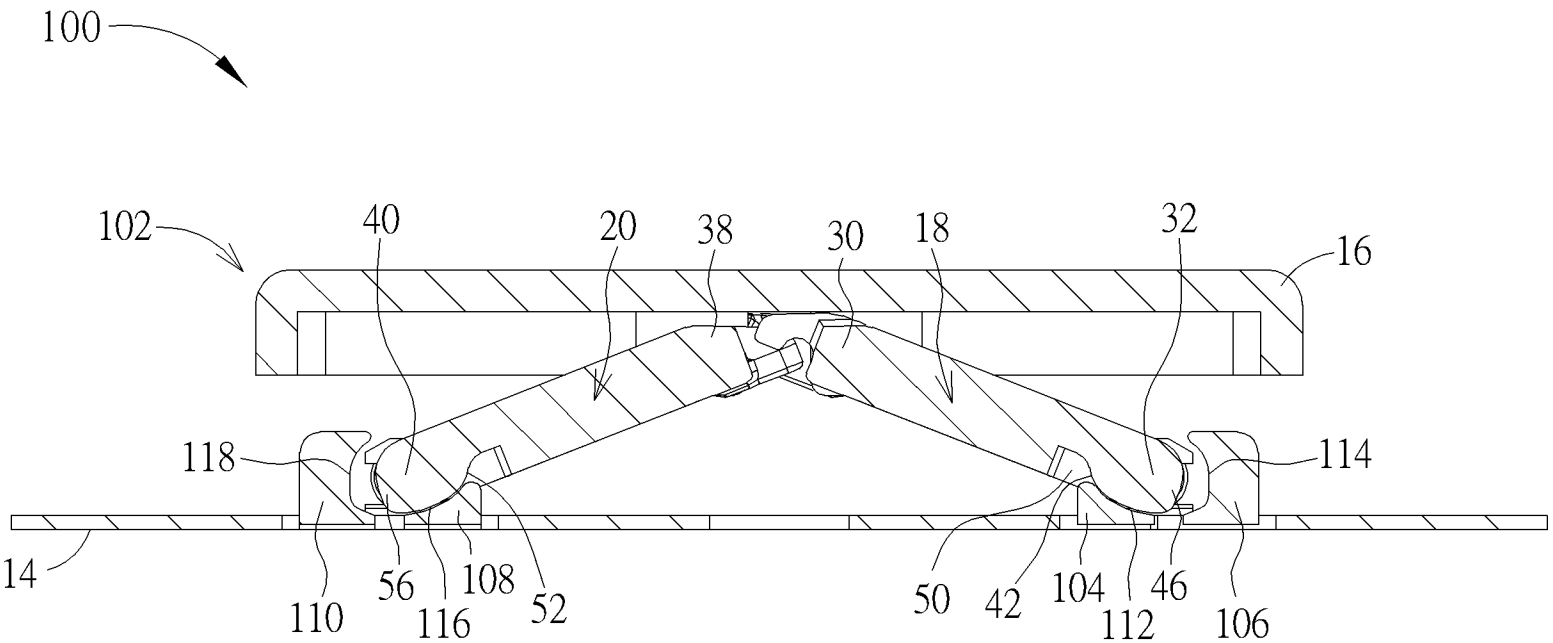
FIG. 8 is a cross-sectional diagram of a keyswitch in FIG. 7 along a cross-sectional line B-B.

The support design of the first support member and the second support member is not limited to the V-shaped support mechanical design mentioned in the aforesaid embodiments, meaning that the present invention could adopt the inverted V-shaped support mechanical design. For example, please refer to FIG. 7 and FIG. 8. FIG. 7 is a partial exploded diagram of a keyboard 100 according to another embodiment of the present invention. FIG. 8 is a cross-sectional diagram of a keyswitch 102 in FIG. 7 along a cross-sectional line B-B. There is only one keyswitch 102 shown in FIG. 7. As for the related description for other keyswitches 102 utilizing the same design, it could be reasoned by analogy according to this embodiment. Components both mentioned in this embodiment and the aforesaid embodiments represent components with similar structures or functions, and the related description is omitted herein. As shown in FIG. 7 and FIG. 8, the keyboard 100 includes a plurality of keyswitches 102 for a user to perform input operations. The keyswitch 102 preferably includes the board 14, the cap 16 (could be selectively omitted in this embodiment), the first support member 18, the second support member 20, a first block 104, a second block 106, a third block 108, and a fourth block 110.

In this embodiment, the first sliding end portion 32 of the first support member 18 and the second sliding end portion 40 of the second support member 20 are slidably connected to the board 14, and the first pivot end portion 30 of the first support member 18 and the second pivot end portion 38 of the second support member 20 are pivoted to the cap 16. As such, the first sliding end portion 32 and the second sliding end portion 40 can move along the involute tracks (i.e. the first involute track and the second involute track) relative to the first pivot end portion 30 and the second pivot end portion 38 respectively with movement of the cap 16. In such a manner, via the connection design that the first support member 18 and the second support member 20 are opposite to each other and are slidably connected to the board 14 and pivoted to the cap 16 for forming an inverted V-shaped support mechanism, the cap 16 can move between the non-pressed position and the pressed position relative to the board 14.

Furthermore, as shown in FIG. 7 and FIG. 8, the first block 104 is formed on the board 14 and located at the inner side of the first sliding end portion 32. The first convex structure 42 of the first sliding end portion 32 abuts against the first block 104 when the cap 16 is located at the non-pressed position. A first concave structure 112 extends from the first block 104 correspondingly along the first involute track of the first sliding end portion 32. The second block 106 is formed on the board 14 and located at the outer side of the first sliding end portion 32 to be aligned with the first block 104. The second convex structure 46 of the first sliding end portion 32 abuts against the board 14 when the cap 16 is located at the non-pressed position. A second concave structure 114 extends from the second block 106 correspondingly along the first involute track of the first sliding end portion 32. As such, when the first sliding end portion 32 moves along the first involute track, the first convex structure 42 abuts against the first block 104 or is spaced apart from the first concave structure 112, and the second convex structure 46 abuts against the board 14 or the second concave structure 114. To be more specific, via the first convex structure 42, the first concave structure 112, the second convex structure 46 and the second concave structure 114 extending along the first involute track of the first sliding end portion 32 respectively, the first block 104 can be spaced apart from the first support member 18 at a proper gap during the process of the cap 16 being pressed and can block the first support member 18 when the cap 16 is located at the non-pressed position, and the second block 106 can be spaced apart from the first support member 18 at a proper gap during the process of the cap 16 being pressed and can block the first support member 18 when the cap 16 is located at the pressed position.

Similarly, the third block 108 is formed on the board 14 and located at the inner side of the second sliding end portion 40. The third convex structure 52 of the second sliding end portion 40 abuts against the third block 108 when the cap 16 is located at the non-pressed position. A third concave structure 116 extends from the third block 108 correspondingly along the second involute track of the second sliding end portion 40. The fourth block 110 is formed on the board 14 and located at the outer side of the second sliding end portion 40 to be aligned with the third block 108. The fourth convex structure 56 of the second sliding end portion 40 abuts against the board 14 when the cap 16 is located at the non-pressed position. A fourth concave structure 118 extends from the fourth block 110 correspondingly along the second involute track of the second sliding end portion 40. As such, when the second sliding end portion 40 moves along the second involute track, the third convex structure 52 abuts against the third block 108 or is spaced apart from the third concave structure 116, and the fourth convex structure 56 abuts against the board 14 or the fourth concave structure 118. To be more specific, via the third convex structure 52, the third concave structure 116, the fourth convex structure 56 and the fourth concave structure 118 extending along the second involute track of the second sliding end portion 40 respectively, the third block 108 can be spaced apart from the second support member 20 at a proper gap during the process of the cap 16 being pressed and can block the second support member 20 when the cap 16 is located at the non-pressed position, and the fourth block 110 can be spaced apart from the second support member 20 at a proper gap during the process of the cap 16 being pressed and can block the second support member 20 when the cap 16 is located at the pressed position.

In such a manner, the keyswitch 102 of the present invention can efficiently solve the prior art problem that the V-shaped support mechanical design causes lateral sliding of the cap relative to the support members, so as to improve the pressing feeling provided by the keyswitch 102. As for the detailed description for the other related designs of the keyswitch 102 (e.g. the design that the first support member and the second support member are pivoted to the cap at different shafts or the same shaft, the design of omitting the third block and the fourth block, the concave slot design, the block arrangement design, and so on), it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a cap movable between a non-pressed position and a pressed position, a sliding slot being formed on the cap;

a first support member having a first sliding end portion, the first sliding end portion being slidably connected to the cap to be movable along with movement of the cap;

a second support member slidably connected to the cap, the second support member being opposite to the first support member;

a first block formed in the sliding slot, a first concave structure extending from an outer side of the first block, the first sliding end portion having a first convex structure, the first convex structure abutting against the first block or being spaced apart from the first concave structure at a first gap when the first sliding end portion moves along with movement of the cap; and a second block formed on the cap and aligned with the first block, a second concave structure extending from the second block, the first sliding end portion further having a second convex structure, and the second convex structure abutting against the cap or the second concave structure when the first sliding end portion moves in response to the cap;

wherein a concave slot corresponding to the first block is formed on the first support member with the first convex structure being formed in the concave slot;

wherein the first block is configured to enter the concave slot to be spaced apart from the first convex structure when the cap is located at the pressed position.

2. The keyswitch of claim 1, wherein a sliding shaft protrudes from the first sliding end portion toward the sliding slot, and the sliding shaft is slidably inserted into the sliding slot to guide sliding of the first sliding end portion.

3. The keyswitch of claim 1, wherein the second support member has a second sliding end portion, the second sliding end portion is slidably connected to the cap to be movable along a second involute track with movement of the cap, and the keyswitch further comprises:

a third block formed on the cap, a third concave structure extending from the third block along the second involute track, the second sliding end portion having a third convex structure, the third convex structure abutting against the third block or being spaced apart from the third concave structure at a second gap when the second sliding end portion moves along the second involute track; and a fourth block formed on the cap, a fourth concave structure extending from the fourth block along the second involute track, the second sliding end portion further having a fourth convex structure, the fourth convex structure abutting against the cap or the fourth concave structure when the second sliding end portion moves along the second involute track.

4. The keyswitch of claim 1, wherein the keyswitch further comprises a board, the first support member further has a first pivot end portion, the second support member has a second pivot end portion, and the first pivot end portion and the second pivot end portion are pivoted to the board to make the cap movable between the non-pressed position and the pressed position relative to the board.

5. The keyswitch of claim 4, wherein a pivot sheet is formed on the board and has a first pivot hole and a second pivot hole, a first shaft protrudes from the first pivot end portion toward the first pivot hole, a second shaft protrudes from the second pivot end portion toward the second pivot hole, the first shaft is pivotably inserted into the first pivot hole, and the second shaft is pivotably inserted into the second pivot hole.

6. The keyswitch of claim 4, wherein the first pivot end portion is pivoted to the second pivot end portion in a shaft-hole engagement manner.

7. The keyswitch of claim 1, wherein the cap moves a travelling distance between the non-pressed position and the pressed position, the first convex structure abuts against the first block when the cap is located at the non-pressed position, the first convex structure is spaced apart from the first concave structure at the first gap when the cap moves a first distance downward from the non-pressed position, the second convex structure abuts against the cap when the cap is located at the non-pressed position, the second convex structure abuts against the second concave structure when the cap moves a second distance downward to the pressed position, and a sum of the first distance and the second distance is equal to the travelling distance.

8. A keyswitch comprising:

a cap movable between a non-pressed position and a pressed position, a sliding slot being formed on the cap;

a board disposed opposite to the cap;

a first support member and a second support member opposite to each other and slidably connected between the cap and the board, the first support member having a first sliding end portion, the first sliding end portion being slidably connected to the cap to be movable along with movement of the cap, the first sliding end portion having a first convex structure;

a first block formed in the sliding slot, a first concave structure extending from the first block; and a second block formed on the cap and aligned with the first block, a second concave structure extending from the second block, the first sliding end portion further having a second convex structure, and the second convex structure abutting against the cap or the second concave structure when the first sliding end portion moves in response to the cap;

wherein when the first sliding end portion moves along with movement of the cap, the first convex structure of the first sliding end portion abuts against the first block or is spaced apart from the first concave structure;

wherein a concave slot corresponding to the first block is formed on the first support member with the first convex structure being formed in the concave slot;

wherein the first block is configured to enter the concave slot to be spaced apart from the first convex structure when the cap is located at the pressed position.

9. The keyswitch of claim 8, wherein the second support member has a second sliding end portion, the second sliding end portion and the first sliding end portion are slidably connected to the cap to make the second sliding end portion movable along a second involute track, the second sliding end portion has a third convex structure and a fourth convex structure, and the key switch further comprises:

a third block and a fourth block formed on the cap and opposite to each other, a third concave structure and a fourth concave structure extending from the third block and the fourth block respectively along the second involute track;

wherein when the second sliding end portion moves along the second involute track, the third convex structure of the second sliding end portion abuts against the third block or is spaced apart from the third concave structure at a second gap, and the fourth convex structure of the second sliding end portion abuts against the cap or the fourth concave structure.

10. A keyswitch comprising:

a cap movable between a non-pressed position and a pressed position, a sliding slot being formed on the cap;

a first support member and a second support member slidably connected to the cap and configured opposite to each other, the first support member having a first sliding end portion slidably connected to the cap to be movable along with movement of the cap, the first sliding end portion having a first convex structure in a concave slot defined on the first support member;

a first block and a third block formed on the cap and opposite to each other, and having a first concave structure and a third concave structure respectively defined at an outer side of each of the first block and the third block, the first block being formed in the sliding slot; and a second block formed on the cap and aligned with the first block, a second concave structure extending from the second block, the first sliding end portion further having a second convex structure, and the second convex structure abutting against the cap or the second concave structure when the first sliding end portion moves in response to the cap;

wherein when the cap moves to the pressed position, the first concave structure of the first block is moved to face the first convex structure in the concave slot of the first support member.

11. The keyswitch of claim 10, wherein a flat surface is defined at an inner side of the first block, a plane is defined at an internal side of the concave slot, and the flat surface of the first block is moved to proximately face the plane of the concave slot when the cap moves to the pressed position.

* * * * *